United States Patent [19]

Kuronaga et al.

[11] Patent Number: 4,768,462

[45] Date of Patent: Sep. 6, 1988

[54] AUTOMATIC SPRAY COATING APPARATUS

[75] Inventors: Tadayoshi Kuronaga, Hiroshima; Toshihumi Ogasahara, Kure; Hideyuki Katoh; Shigehiro Furuya, both of Hiroshima, all of Japan

[73] Assignee: Mazda Motor Corporation, Hiroshima, Japan

[21] Appl. No.: 39,451

[22] Filed: Apr. 17, 1987

[30] Foreign Application Priority Data

Apr. 21, 1986 [JP] Japan ..... 61-60565[U]
Apr. 22, 1986 [JP] Japan ..... 61-92583
Apr. 28, 1986 [JP] Japan ..... 61-99141

[51] Int. Cl.[4] ..... B05B 15/12

[52] U.S. Cl. ..... 118/315; 118/314; 118/323; 118/326; 118/697; 401/43

[58] Field of Search ..... 239/751, 752; 118/314, 118/315, 323, 326, 697; 427/421, 424; 901/43

[56] References Cited

U.S. PATENT DOCUMENTS 4,239,431 12/1980 Davini ..... 414/1
4,498,414 2/1985 Kiba et al. ..... 118/663
4,532,148 7/1985 Vecellio ..... 427/31
4,630,567 12/1986 Bambousek et al. ..... 118/323
4,714,044 12/1987 Kikuchi et al. ..... 118/326
4,721,630 1/1988 Takeo et al. ..... 118/326

FOREIGN PATENT DOCUMENTS 3301022 7/1984 Fed. Rep. of Germany .
56-144763 11/1981 Japan .
60-25565 2/1985 Japan .
2177946 2/1987 United Kingdom ..... 118/697
2180173 3/1987 United Kingdom ..... 118/697

*Primary Examiner*—Shrive P. Beck
*Attorney, Agent, or Firm*—Fleit, Jacobson, Cohn & Price

[57] ABSTRACT

An automatic spray coating apparatus for vehicle bodies comprises first and second cocating stations, said first coating station being provided with a coating robot for coating a front door on one of the sides and the vicinity thereof and a coating robot for coating a rear door on the other side and the vicinity thereof, said second coating station being provided with two coating robots for respectively coating the other doors and the vicinity thereof, and at least one coating robot which coats the insides of an engine compartment and trunk, while the vehicle body is standing still at least one of the first or second coating stations. According to the present invention, it is possible to reduce the time required for coating vehicle bodies with a smaller number of coating stations and to efficiently coat vehicle bodies without interference between coating robots.

4 Claims, 10 Drawing Sheets

AUTOMATIC SPRAY COATING APPARATUS

BACKGROUND OF THE INVENTION

The present invention relates to an automatic spray coating apparatus for vehicle bodies, and more particularly to such an apparatus in which the vehicle bodies are spray-coated by a plurality of coating robots.

DESCRIPTION OF PRIOR ART

As disclosed in unexamined Japanese Patent Publication No. 25565/1985, there has been proposed a coating system which employs multi-joint type robots or multi-arm type robots in addition to reciprocator type and fixed type automatic coating machines so as to automate intercoating or overcoating of articles such as vehicle bodies being conveyed intermittently.

In this prior art system, there are provided a plurality of coating stations and a plurality of coating robots for each of the coating stations so that a coating robot is arranged on each side of a conveyor line of the article for coating its own allotted portion of the article.

According to such arrangement, in case where the number of the coating stations and the area of the article to be coated by each robot is decreased to reduce the space for the coating operation and the total coating time, it is necessary to provide a large number of coating robots at each of the coating stations.

However, in such a case, there arises a problem that coating robots inevitably interfere with each other, unless the portion of the article to be coated by each of the coating robots and the arrangement of the coating robots are properly determined.

SUMMARY OF THE INVENTION

It is therefore the object of the invention to provide an automatic spray coating apparatus having a plurality of coating robots and capable of efficiently spray-coating vehicle bodies being conveyed intermittently with a smaller number of coating stations and a shorter coating time, without interference between the coating robots.

According to the present invention, the above and other objects can be accomplished by an automatic spray coating apparatus for vehicle bodies comprising first and second coating stations, said first coating station being provided with a coating robot for coating a front door on one of the sides and the vicinity thereof and a coating robot for coating a rear door on the other side and the vicinity thereof, said second coating station being provided with two coating robots for respectively coating the other doors and the vicinity thereof, and at least one coating robot which coats the inside of an engine compartment and a trunk, while the vehicle body is standing still at at least one of the first or second coating stations.

In another aspect of the present invention, an automatic spray coating apparatus for vehicle bodies comprises first and second coating stations, each of said coating stations having two floor-mounted type coating robots for coating their own allotted portions of the inside of a cabin of the vehicle body, said two coating robots provided at each of the first and second coating stations being arranged on opposite sides with respect to the vehicle bodies to be conveyed and offset from each other in the direction of conveyance of vehicle bodies and being disposed for coating respective allotted portions of the vehicle bodies which are neither adjacent to nor facing each other, and at least one hanging coating robot for coating the insides of an engine compartment and a trunk, said hanging coating robot being movable in the vertical direction over a conveyor line for the vehicle bodies.

In a further aspect of the present invention, an automatic spray coating apparatus for vehicle bodies being conveyed intermittently comprises first and second coating stations, said first coating stations being provided with first, second and third coating robots, said second coating station being provided with fourth, fifth and sixth coating robots, and a seventh coating robot provided between the first and second coating stations, said total of seven coating robots being arranged to be staggered along a conveyor line of the vehicle bodies on both sides of the vehicle bodies, said first and sixth coating robots coating respective allotted areas at opposite ends on one side of the vehicle body, said seventh coating robot coating an allotted area at both ends on the other side of the vehicle body, said second, third, fourth and fifth coating robots coating respective allotted areas of a middle part of the vehicle body which are neither adjacent to nor facing each other.

In a further aspect of the present invention, an automatic spray coating apparatus for vehicle bodies being conveyed intermittently comprises first and second coating stations, said first coating station being provided with first, second, third and fourth coating robots, said second coating station being provided with fifth, sixth, seventh and eighth coating robots, said respective coating robots being arranged so that two of them are disposed on each side of the vehicle bodies to be conveyed at each of the first and second coating stations and coating respective allotted coating areas of the vehicle body which are neither adjacent to nor facing each other.

The above and other objects and features of the present invention will become apparent from the following description made with reference to the accompanying drawings.

DESCRIPTION OF THE PREFERRED EMBODIMENTS

Figure 1:
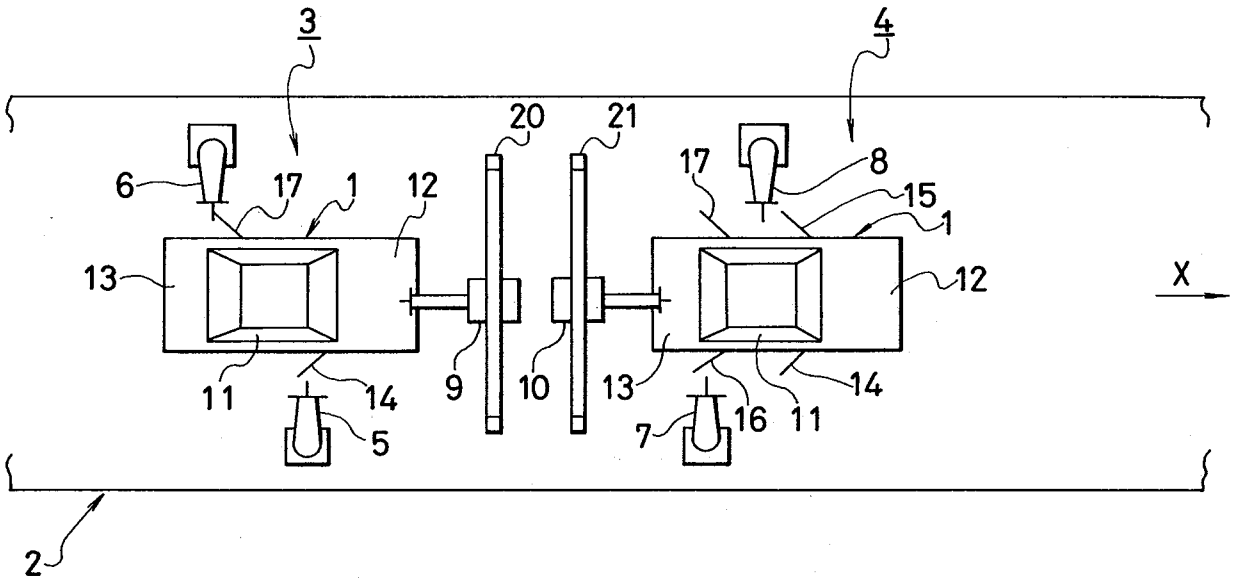
FIG. 1 is a schematic drawing showing a plan view of an automatic spray coating apparatus for coating vehicle bodies which is an embodiment of the present invention.

Referring to FIG. 1, there is shown an automatic spray coating apparatus for intercoating or overcoating inside of vehicle bodies. There are provided a conveyor line 2 on which vehicle bodies 1 are intermittently conveyed in the direction as indicated by an arrow X and first and second coating stations 3 and 4 where the conveyed vehicle body is temporarily stopped to be coated. At the first coating station 3, first and second floor-mounted coating robots 5 and 6 for coating the inside of a cabin 11 of the vehicle body 1 are fixedly installed on a floor in such manner that the first and second robots 5 and 6 are on opposite sides with respect to the vehicle body 1 being conveyed and are offset from each other in the direction of conveyance of the vehicle body 1 so that the first coating robot 5 is located downstream of the second coating robot 6. Similarly, at the second coating station 4, third and fourth floor-mounted coating robots 7 and 8 for coating the inside of the cabin 11 of the vehicle body 1 are fixedly installed on the floor in such manner that the third and fourth robots 7 and 8 are on opposite sides with respect to the vehicle body 1 being conveyed and are offset from each other in the direction of conveyance of the vehicle body 1 so taht the third robot 7 is located upstream of the fourth robot 8. Further, between the first and second coating station 3 and 4, there are provided first and second hanging coating robots 9 and 10 for respectively coating the insides of an engine compartment 12 and a trunk 13 which hang from the above and are movable in the vertical direction.

The floor-mounted coating robots 5, 6, 7 and 8 are capable of opening and closing doors of the vehicle body 1 and the first and second coating robots 5 and 6 are arranged so that they are respectively opposed to a right front door 14 and a left rear door 17 while the vehicle body 1 is standing still at the first coating station 3, and the third and fourth coating robots 7 and 8 are respectively arranged so as to be located opposed to a right rear door 16 and a left front door 15 while the vehicle body 1 is standing still at the second coating station 4.

The first and second hanging coating robots 9 and 10 are electromotive and explosion-proof robots having multiple arms movable three dimensionally and are mounted on gate formed rails 20 and 21 to be movable in the vertical direction and the direction perpendicular to the direction of conveyance of the vehicle body 1. The first hanging coating robot 9 coats the inside of the engine compartment 12 of the vehicle body 1 while it is standing still at the first coating station 3 and the second hanging coating robot 10 coats the inside of the trunk 13 of the vehicle body 1 while it is standing still at the second coating station 4.

The embodiment operates as follows.

The vehicle body 1 is conveyed on and along the conveyor line 2 and is temporarily stopped at the first coating station 3. While the vehicle body 1 is standing still at the first coating station 3, the insides of the right front door 14 and the left rear door 17 of the cabin 11 are respectively coated by the first and second floor-mounted coating robots 5 and 6 and at the same time the inside of the engine compartment 12 is coated by the first hanging coating robot 9 hanging from the rail 20. Then, the vehicle body 1 is conveyed to the second coating station 4 and is temporarily stopped again. While the vehicle body 1 is standing still, the insides of the right rear door 16 and the left front door 15 are respectively coated by the third and fourth floor-mounted coating robots 7 and 8 and at the same time the inside of the trunk 13 is coated by the second hanging coating robot 10 hanging from the rail 21. The hanging robots 9 and 10 are respectively mounted on the rails 20 and 21 so that they can be moved upwardly from the position where the coating is carried out when the vehicle body 1 is conveyed from the first coating station 3 to the second coating station 4. In the above described embodiment, the hanging robots 9 and 10 may be mounted on the rails 20 and 21 so that they can move in the direction of conveyance of the vehicle body 1 for convenience of the coating operation.

According to the above described embodiment, since the two coating robots provided for each coating station coat their own allotted portions of the vehicle body 1 which are neither adjacent to nor facing each other, it is possible to prevent the coating robots from interfering with each other, to efficiently coat the insides of the vehicle body number of coating robots, and to reduce the amount of space required for installation of the coating robots.

Figure 2:
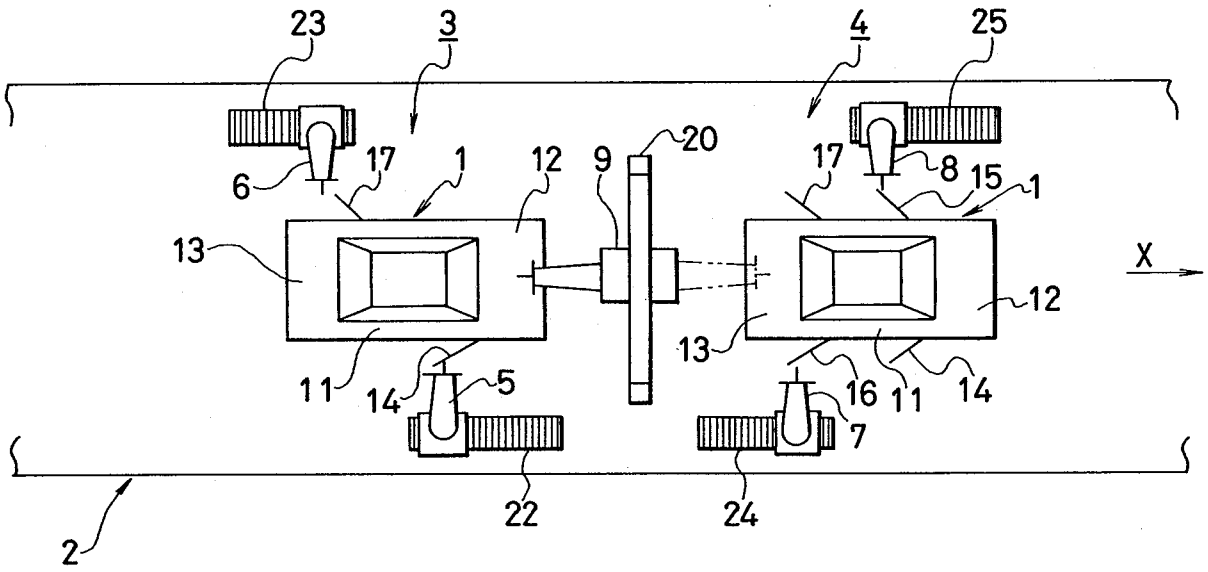
FIG. 2 is a schematic drawing showing a plan view of an automatic spray coating apparatus for coating vehicle bodies which is another embodiment of the present invention.

FIG. 2 shows the automatic spray coating apparatus for vehicle bodies 1 which is another embodiment of the present invention.

In this embodiment, the distance between the first and second coating station 3 and 4 is shortened as compared with the previous embodiment, each of the floor-mounted coating robots 5, 6, 7 and 8 are mounted on guide members 22, 23, 24 and 25 so as to be movable in the direction of conveyance of the vehicle bodies 1, and there is provided only one hanging coating robot 9 mounted on the rail 20 for coating the insides of the engine compartment 12 and the trunk 13. The floor-mounted coating robots 5, 6, 7 and 8 are movable along the guide members 22, 23, 24 and 25 so that the first and fourth robots 5 and 8 can coat the inside portions of the engine compartment 12 in addition to the respective portions allotted to them in the previous embodiment and that the second and third robots 6 and 7 can coat the inside portions of the trunk 12 in addition to the portions coated by them in the previous embodiment. Further, the hanging coating robot 9 is rotatable over a 180-degree arc so that after it coats the engine compartment 12 of the vehicle body 1 standing still at the first coating station 3, it rotates across a 180-degree arc and can coat the trunk 13 of the vehicle body 1 standing still at the second coating station 4.

The embodiment operates as follows.

The vehicle body 1 is conveyed on and along the convey line 2 and is temporarily stopped at the first coating station 3. While the vehicle body 1 is standing still, the inside of the right front door 14 and the left rear door 17 are respectively coated by the first and second floor-mounted coating robots 5 and 6 and then the first and second robots 5 and 6 are moved to a second position along the guide members 22 and 23 in the direction of conveyance of the vehicle body 1 to coat the right side portion in the engine compartment 12 and the left side portion in the trunk 13, respectively, and at the same time the center portion in the engine compartment 12 is coated by the hanging coating robot 9. Then the vehicle body 1 is conveyed to the second coating station 4 and is temporarily stopped there. The inside of the right rear door 16 and the left front door 17 of the cabin 11 are coated by the third and fourth floor-mounted coating robots 7 and 8 and then the third and fourth robots 7 and 8 are moved to a second position along the guide members 24 and 25 in the direction of conveyance of the vehicle body 1 to coat the right side portion in the trunk 13 and the left side portion in the engine compartment 12, and at the same time the center portion in the trunk 13 is coated by the hanging coating robot 9 rotated across a 180-degree arc.

According to the above-described embodiment, in addition to the technical advantages of the previous embodiment, it is further possible to reduce the number of coating robots by one robot and, as a result, to further reduce the amount of space needed for installing the coating robots as compared with the previous embodiment.

Figure 3:
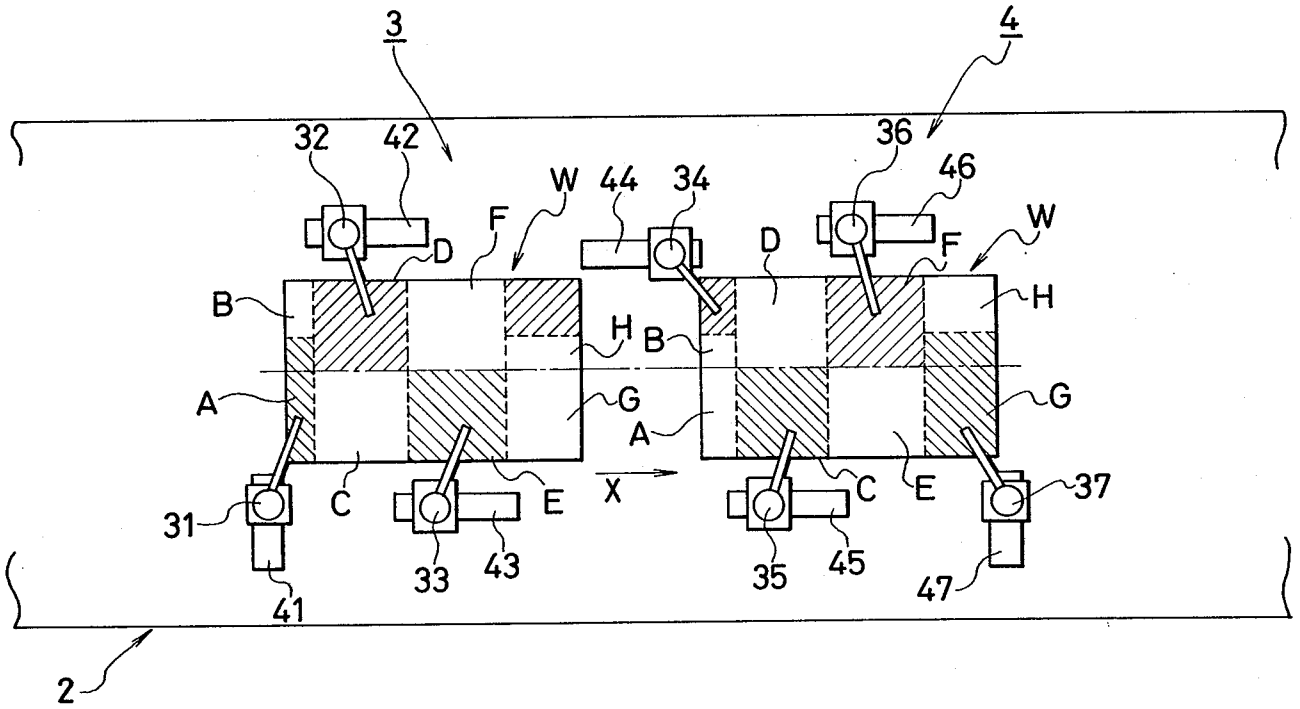
FIG. 3 is a schematic drawing showing a plan view of an automatic spray coating apparatus for coating vehicle bodies which is a further embodiment of the present invention.
Figure 4:
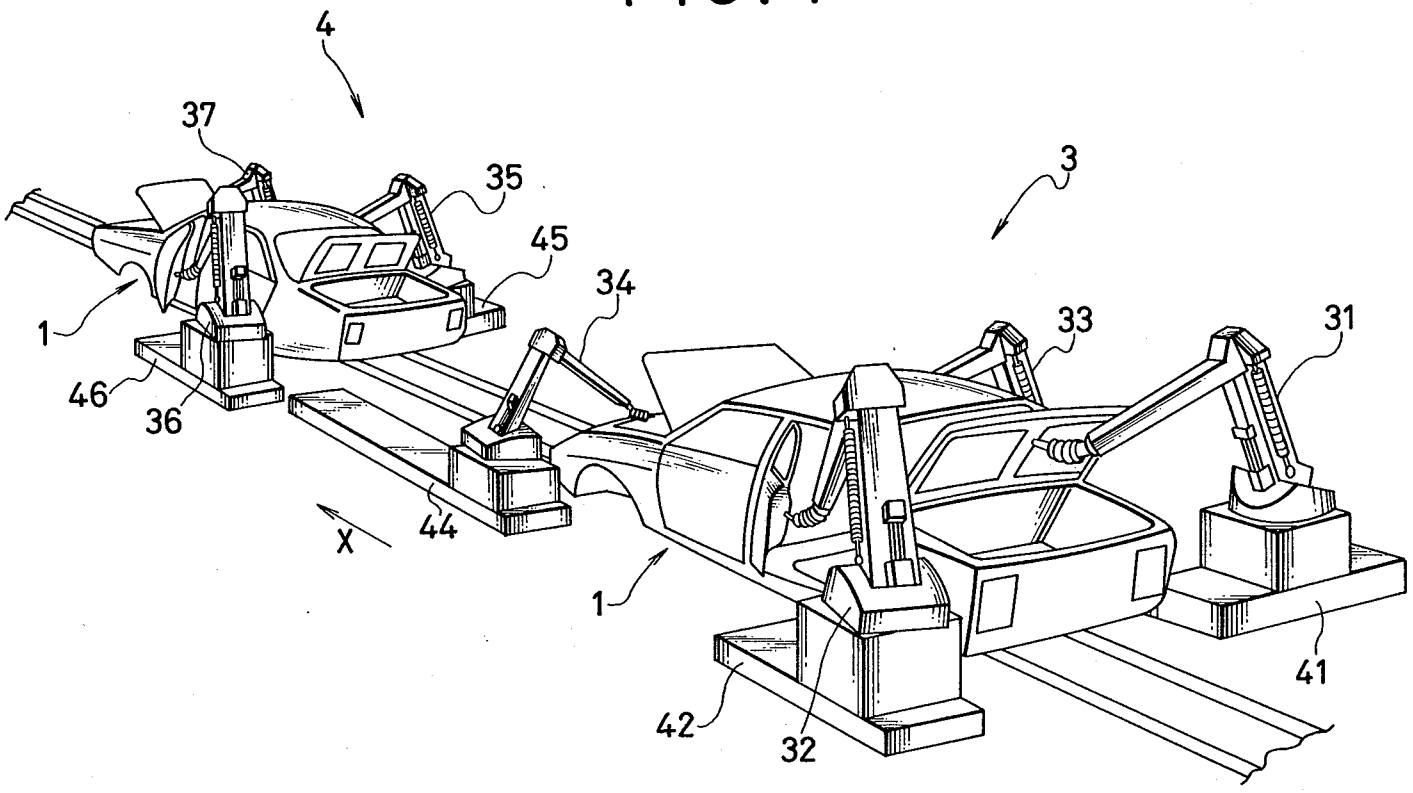
FIG. 4 is a schematic drawing showing a perspective view of the embodiment shown in FIG. 3.

FIG. 3 and 4 show an automatic spray coating apparatus for the inside of vehicle bodies 1 which is a further embodiment of the present invention.

Referring to FIGS. 3 and 4, there are provided a conveyor line 2 on which vehicle bodies 1 are intermittently conveyed and first and second coating station 3 and 4 where the vehicle body 1 is temporarily stopped to be coated in a similar manner to that in the previous embodiments. At the first coating station 3, first and third multi-joint type coating robots 31 and 33 are arranged to be located on the right side of the vehicle body 1 to be conveyed with respect to the direction of conveyance of the vehicle body 1 as indicated by an arrow X and the third coating robot 33 is located downstream of the first coating robot 31 by a predetermined distance, and further, a second multi-joint type coating robot 32 is arranged to be located on the left side of the vehicle body 1 to be conveyed with respect to the direction of conveyance of the vehicle body 1 as indicated by the arrow X and between the first and third coating robots 21 and 23 with respect to the direction of conveyance of the vehicle body 1.

Between the first and second coating stations 3 and 4 there is provided a fourth multiple-joint type coating robot 34 on the same side as the second coating robot 32.

At the second coating station 4, there are provided fifth, sixth and seventh multi-joint type coating robots 35, 36 and 37. The fifth and seventh coating robots 35 and 37 are located on the right side of the vehicle body 1 to be conveyed with respect to the direction of conveyance of the vehicle body 1 as indicated by the arrow X and the seventh coating robot 37 is located downstream of the fifth coating robots 35 by a predetermined distance. The sixth coating robot 36 is located on the left side of the vehicle body 1 to be conveyed and between the fifth and seventh coating robots 35 and 37 will respect to the direction of conveyance of the vehicle body 1 as indicated by the arrow X.

As shown in FIG. 3, the vehicle body 1 is divided into eight subportions A to H so that the subportions A, C, E and G constitute the right side of vehicle body 1 to be coated with respect to the direction of conveyance as indicated by the arrow X and that the subportions B, D, F and H constitute the left side of the vehicle body 1 to be coated. In other words, the cabin 11 is divided into four subportions C, D, E and F and the engine compartment 12 is divided into two subportions G and H and the trunk 13 is divided into two subportions A and B. The respective first to seventh coating robots 31 to 37 are assigned to the predetermined subportion(s) of A to H.

The first coating robot 31 is installed on a guide member 41 so as to be movable in the direction perpendicular to that of conveyance of the vehicle body 1 so that it can approach the vehicle body 1 standing still at the first coating station 3 when coating and depart from the coating position when waiting, and while the vehicle body 1 is standing still at the first coating station 3, it coats the subportion A and a part of the subportion B, that is, the right half and the right part of the left half in the trunk 13 of the vehicle body 1.

The second and third coating robots 32 and 33 are respectively installed on guide members 42 and 43 so as to be movable in the direction of conveyance of the vehicle body 1 as indicated by the arrow X so that they can respectively coat the subportions D and E, that is, the rear left side of cabin 11 and the front right side of cabin 11 of the vehicle body 1. These subportions are neither adjacent to nor facing each other.

The fourth multi-joint type coating robot 34 is also installed on the guide member 44 so as to be movable in the direction of conveyance of the vehicle body 1 between a forward portion, that is a position opposite the engine room 12 of the vehicle body 1 standing still at the first coating station 3, and the rearward portion, that is a position opposite the trunk 13 of the vehicle body 1 standing still at the second coating station 4, and while the vehicle body 1 is standing still at the first coating station 3, it coats a part of the subportion H, namely the left part of the left half of the engine compartment 12.

The coating operations by the first, second, third and fourth coating robots are carried out synchronously.

After the coating operation at the first coating station 3 is completed, the vehicle body 1 is conveyed to the second coating station 4 and is temporarily stopped there.

The fifth, sixth and seventh coating robots 35, 36 and 37 are assigned predetermined subportion(s) of A to H in a similar manner to the first, second, third and fourth coating robots 31, 32, 33 and 34.

The fifth and sixth coating robots 35 and 36 are respectively mounted on guide members 45 and 46 so as to be movable in the direction of conveyance of the vehicle body 1 as indicated by the arrow X and respectively coat the subportions C and F, that is, the rear right side portion of the cabin 11 and the front left side portion of the cabin 11. These subportions are neither adjacent to nor facing each other.

The seventh coating robot 37 is installed on a guide member 47 so as to be movable in the direction perpendicular to that of conveyance of the vehicle body 1 as indicated by the arrow X so that it can approach the vehicle body 1 standing still at the second coating station 4 when coating and can depart from the vehicle body 1 when waiting, and it coats the subportion G and the part of the subportion H which has not been coated by the fourth coating robot 24, namely the right half and the right side part of the left half of the engine compartment 12.

Further, the fourth coating robot 34 is moved to the second coating station 4 and coats the part of the subportion B which has not been coated by the first coating robot 21, namely the left part of the left half of the trunk 13 of the vehicle body 1 standing still at the second coating station 4.

The coating operations by the fourth, fifth, sixth and seventh coating robots 34, 35, 36 and 37 are carried out synchronously.

Since the automatic spray coating apparatus of this embodiment is designed to coat vehicle bodies 1 conveyed one afteranother on the conveyor line 2, the fourth coating robot 34 has to coat its allotted portions of one vehicle body 1 standing still at the first coating station 3 and another one standing still at the second coating station 4 and, therefore, the area allotted to the fourth coating robot 24 is set smaller than those to be coated by the other robots so as to equalize the coating time for all of the coating robots.

As described above, the first to seventh coating robots are staggered along the conveyor line 2 and each of the coating robots coats its allotted subportion(s) A to H of the vehicle body 1 standing still at the first or second coating station. Afterward, the vehicle body 1 is forwarded to a next processing step such as a step for coating the outside of the vehicle body 1.

According to the above described embodiment, since the respective coating robots coat their own allotted subportions A to H of the vehicle body 1 which are neither substantially adjacent to nor facing each other at each of the first and second coating stations 3 and 4, it is possible to prevent adjacent coating robots from interfering with each other without providing a further coating station for making the distance between the adjacent coating robots longer and preventing them from interfering with each other. Therefore, it is possible to coat the vehicle bodies with a smaller number of coating stations and to reduce the area to be coated by each of the coating robots thereby remarkable reducing the coating time.

Further, in the above described embodiment, since the fourth coating robot 34 is located between the first and second coating stations 3 and 4 and is constituted to be a coating robot for both the first and second coating stations 3 and 4, in the case where vehicle bodies 1 having neither an engine compartment nor a trunk are coated, it is possible to decrease the number of robots which do not operate.

Figure 5:
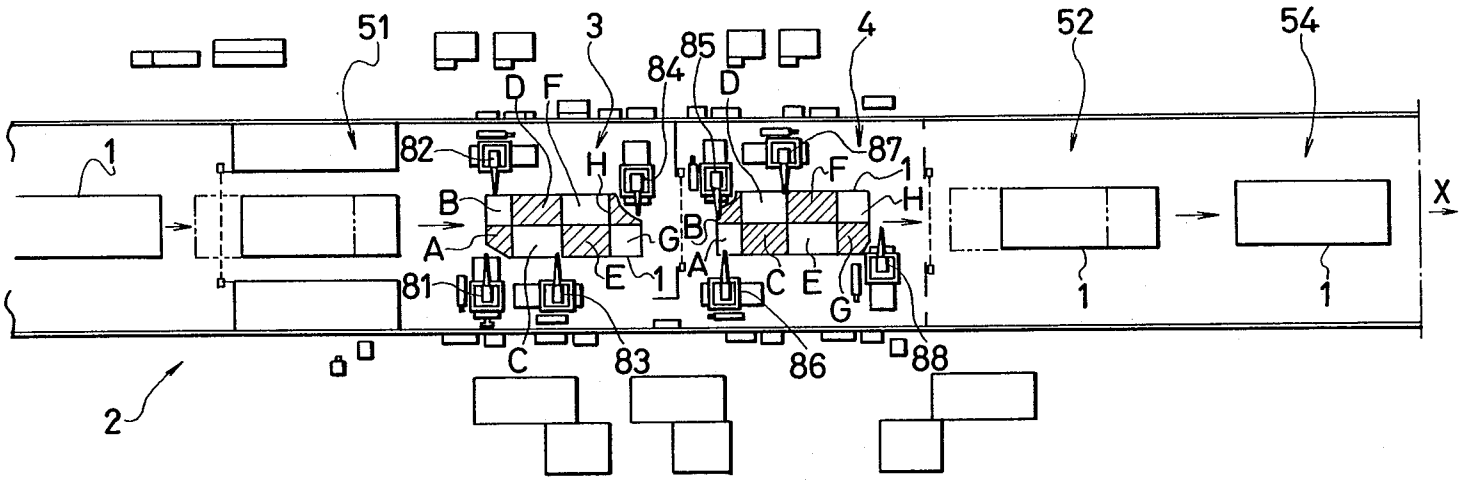
FIG. 5 is a schematic drawing showing a plan view of an automatic spray coating apparatus for coating vehicle bodies which is a further embodiment of the present invention.
Figure 6:
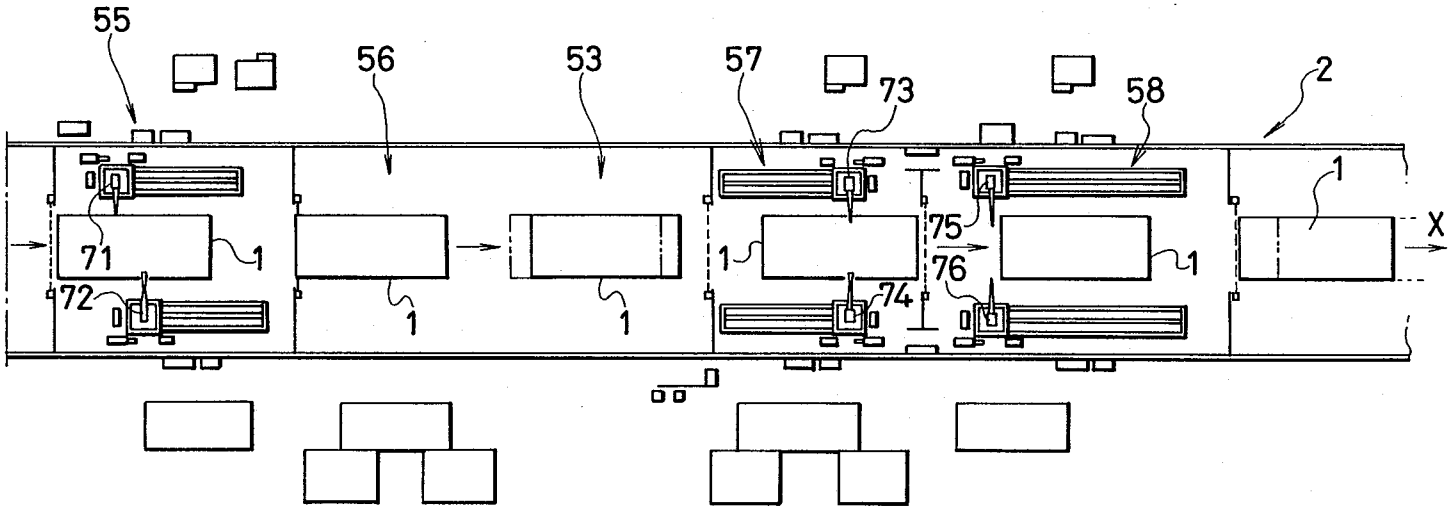
FIG. 6 is a schematic drawing showing a plan view of an automatic spray coating apparatus for coating vehicle bodies which is connected to the right end of FIG. 5.
Figure 7:
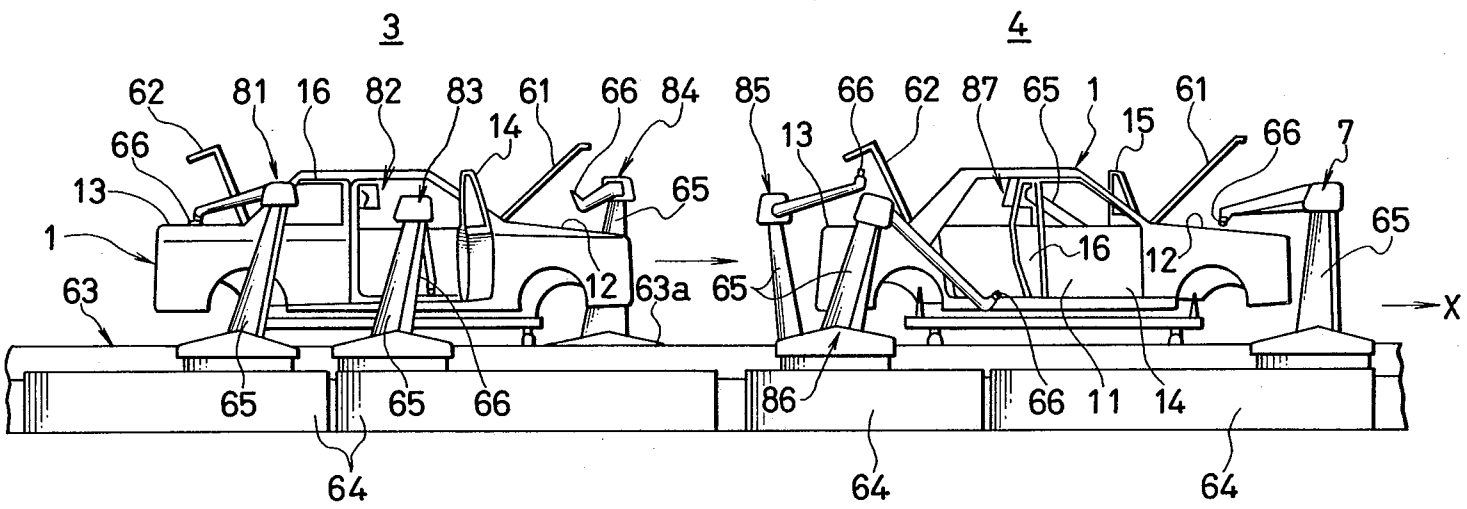
FIG. 7 is a schematic drawing showing a partial side view of the automatic spray coating apparatus for vehicle bodies shown in FIG. 5.

FIGS. 5, 6 and 7 show an automatic spray coating apparatus for vehicle bodies which is a further embodiment of the present invention.

Referring to FIGS. 5, 6 and 7, there are provided a conveyor line 2 on which vehicle bodies 1 are intermittently conveyed in the direction as indicated by an arrow X, and the first and second coating stations 3 and 4 in a similar manner to the previous embodiments. The mode of conveyance of the vehicle body 1 is changed from continuous conveyance to intermittent (tact) conveyance at stations 51 and 53 and from intermittent conveyance to continuous conveyance at a station 52. Further, there are provided third, fourth, fifth, sixth and seventh coating stations 54, 55, 56, 57 and 58.

At the first and second stations the doors 14 to 17 of the cabin 11, the engine compartment 12 and the trunk 13 of the vehicle body being conveyed intermittently are coated.

At the station 52 portions of the vehicle body 1 which have not been satisfactorily coated at the first and second coating stations 3 and 4 are manually coated and jigs for holding open a hood 61 and a trunk lid 62 during coating of the insides of the engine compartment 12 and the trunk 13 are removed.

At the third station 54, top and side surfaces of the vehicle body 1 are coated by an automatic coating apparatus (not shown) and at the fourth coating station 55 outer plates are coated by coating robots 71 and 72, and further at the fifth coating station 56 the vehicle body 1 is coated by an automatic coating apparatus (not shown).

At the station 53 portions of the vehicle body 1 which have not been satisfactorily coated at the preceding stations are manually coated.

At the sixth and seventh coating stations 57 and 58, coating robots 73 and 76 having means for opening the doors 14 and 17 are arranged such that the robots 73 and 75 are on the left side of the vehicle body 1 to be conveyed with respect to the direction of conveyance of the vehicle body 1 and that the robots 74 and 76 are on the right side of the vehicle body 1 to be conveyed with respect to said direction, and front and rear portions of the vehicle body 1 are divided into areas and clear and solid coating are applied to the inside of the cabin 11 by the robots 73 to 76.

As shown in FIG. 5, the portion of the vehicle body 1 to be coated at each of the first and second coating stations 3 and 4 is divided into eight subportions A to H in a similar manner to the previous embodiment shown in FIG. 3.

At the first coating station 3 there are provided first, second, third and fourth coating robots 81, 82, 83 and 84. The second and third coating robots 82 and 83 are arranged to be able to respectively coat their own allotted subportions D and E at a middle part of the vehicle body 1, that is, the cabin 11, which are neither adjacent to nor facing each other. The first and fourth coating robots 81 and 84 are arranged to be able to respectively coat their own allotted subportions A and H at end parts of the vehicle body 1, that is, the right half of the trunk 13 and the left half of the engine compartment 12. These subportions are neither adjacent to nor facing the subportions D and E.

At the second coating station 4 there are provided fifth, sixth, seventh and eighth coating robots 85, 86, 87 and 88. The sixth and seventh robots 86 and 87 are arranged to be able to respectively coat their own allotted subportions C and F in the cabin 11 of the vehicle body 1. These subportions are neither adjacent to nor facing each other. The fifth and eighth coating robots 85 and 88 are arranged to be able to respectively coat the subportions B and G, that is, the left half of the trunk 13 and the right half of the engine compartment 12. These subportions are neither adjacent to nor facing the subportions C and F.

FIG. 7 shows the first and second coating stations 3 and 4 in detail. In FIG. 7 the vehicle body 1 to be coated is intermittently conveyed from the left to the right by a predetermined distance per predetermined time interval by conveyor means 63 consisting of a conveyor belt 63a. The respective first to eighth coating robots 81 and 88 are movable on guide members 64 in both the direction of conveyance of the vehicle body 1 and perpendicular to this direction. A multiple-joint arm 65 is provided for each coating robot and can be moved in a predetermined manner so that a coating gun 66 disposed at the end thereof can spray coat a composition onto the subportion allotted to the coating robot.

At the first coating station 3 the third coating robot 83 coats the right front door 14 and the vicinity thereof (the suportion E) and the second coating robot 82 coats the left rear door 17 and the vicinity thereof (the subportion D) (not shown in FIG. 7). The second and third coating robots 82 and 83 have means (not shown) for opening and closing doors 14, 15, 16 or 17 in the vicinity of the coating gun 66 thereof. Further, the fourth coating robot 84 coats a left side portion of the engine compartment 12 (the subportion H) and the first coating robot 81 coats a right side portion of the trunk 13 (the subportion A) and while they are being coated by the first and fourth coating robots 81 an 84, the hood 61 and the trunk lid 62 are maintained open.

At the second coating station 4 the seventh coating robot 87 coats the left front door 15 and the vicinity thereof (the subportion F) and the sixth coating robot 86 coats the right rear door 16 and the vicinity thereof (the subportion C). The coating robots 86 an 87 have means (not shown) for opening and closing doors 14, 15, 16 or 17 in the vicinity of the coating gun 66 thereof. Further, the eighth coating robot 88 coats a right side portion of the engine compartment 12 (the subportion G) and the fifth coating robot 85 coats a left side portion of the trunk 13 (the subportion B).

Figure 8:
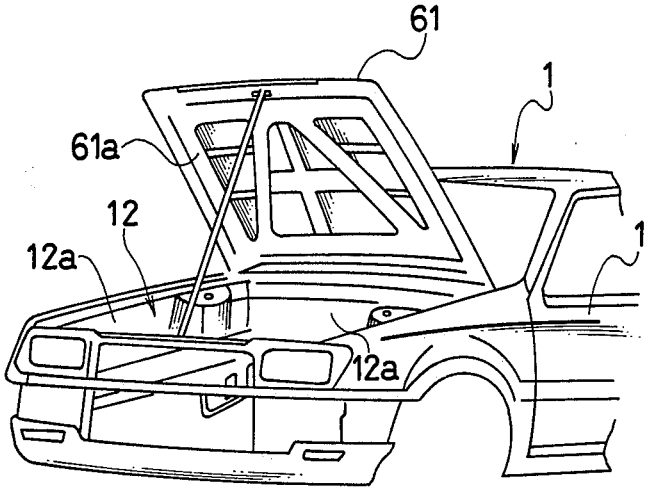
FIG. 8 is a schematic drawing showing a perspective view of an engine compartment of the vehicle body to be coated in the embodiment shown in FIG. 5.

FIG. 8 shows the engine compartment 12 and the vicinity thereof which are the coated portions allotted to the fourth and eighth coating robots 84 and 88 and an inner wall 12*a* of the engine compartment 12 and an inner surface 61*a* of the hood 61 are respectively divided into right and left halves which are respectively coated by the fourth and eighth coating robots 84 and 88.

Figure 9:
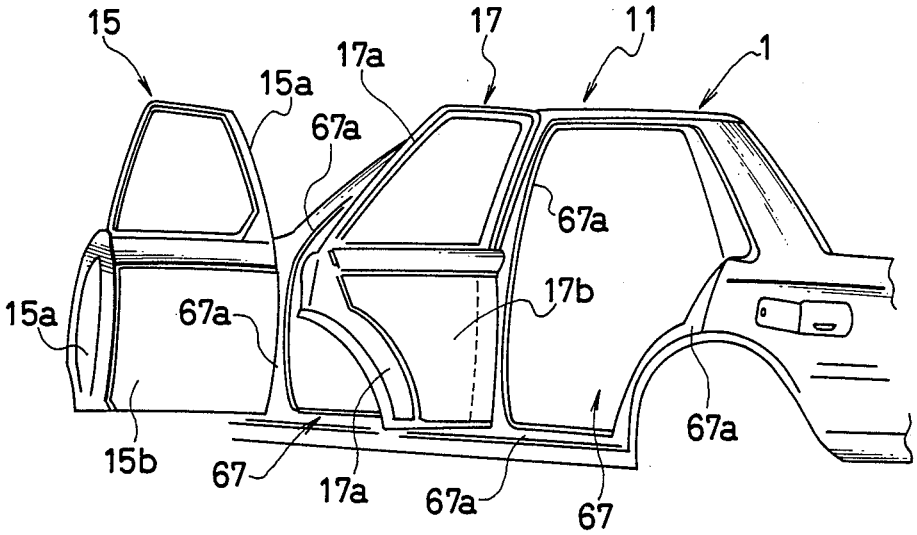
FIG. 9 is a schematic drawing showing a perspective view of a door portion of a vehicle body to be coated in the embodiment shown in FIG. 5.

FIG. 9 shows left door portions which are the portions allotted to the second and seventh coating robots 82 and 87 at the middle part (the cabin 11) of the vehicle body 1 and respective inside peripheries 15*a* and 17*a* of the left front door 15 and left rear door and 17, inner panel 15*b* and 17*b* and peripheries 67*a* of openings 67 of the doors 15 and 17 are respectively coated by the second and seventh coating robots 82 and 87. Similarly, right door portions are coated by the third and sixth coating robots 83 and 84 respectively.

Figure 10:
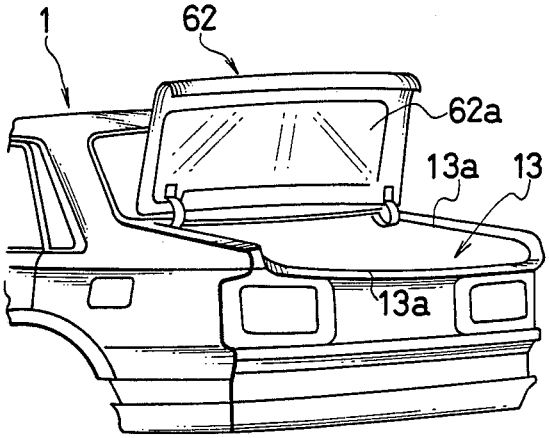
FIG. 10 is a schematic drawing showing a perspective view of a trunk of a vehicle body to be coated in the embodiment shown in FIG. 5.

FIG. 10 shows the trunk 13 and neighboring regions thereof, which are the portions allotted to the first and fifth coating robots 81 and 85, and inner surface 62*a* of the trunk lid 62 and periphery 13*a* of the trunk room 13 are respectively divided into right and left halves which are respectively coated by the first and fifth coating robots 81 and 85.

Figure 11:
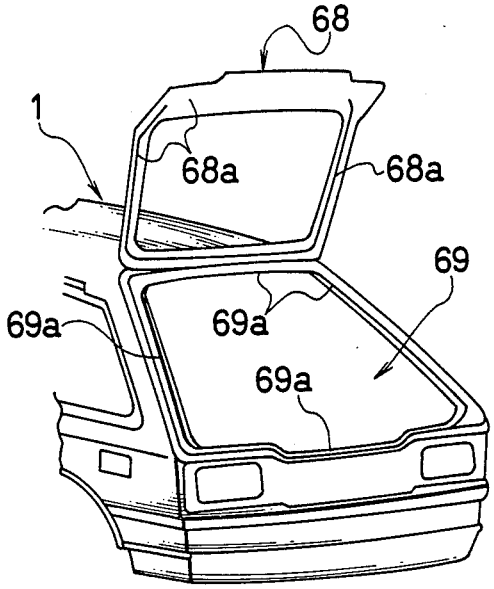
FIG. 11 is a schematic drawing showing a perspective view of a hatchback door portion of a vehicle body having a hatchback structure to be coated in the embodiment shown in FIG. 5.

FIG. 11 shows rear portions of a vehicle body 1 having a hatchback structure to be coated by the first and fifth coating robots 81 and 85, and the inner periphery 68*a* of a hatchback type door 68 and the periphery 69*a* of the opening 69 of the door are respectively divided into right and left halves which are respectively are coated by the first and fifth coating robots 81 and 85.

Figure 12:
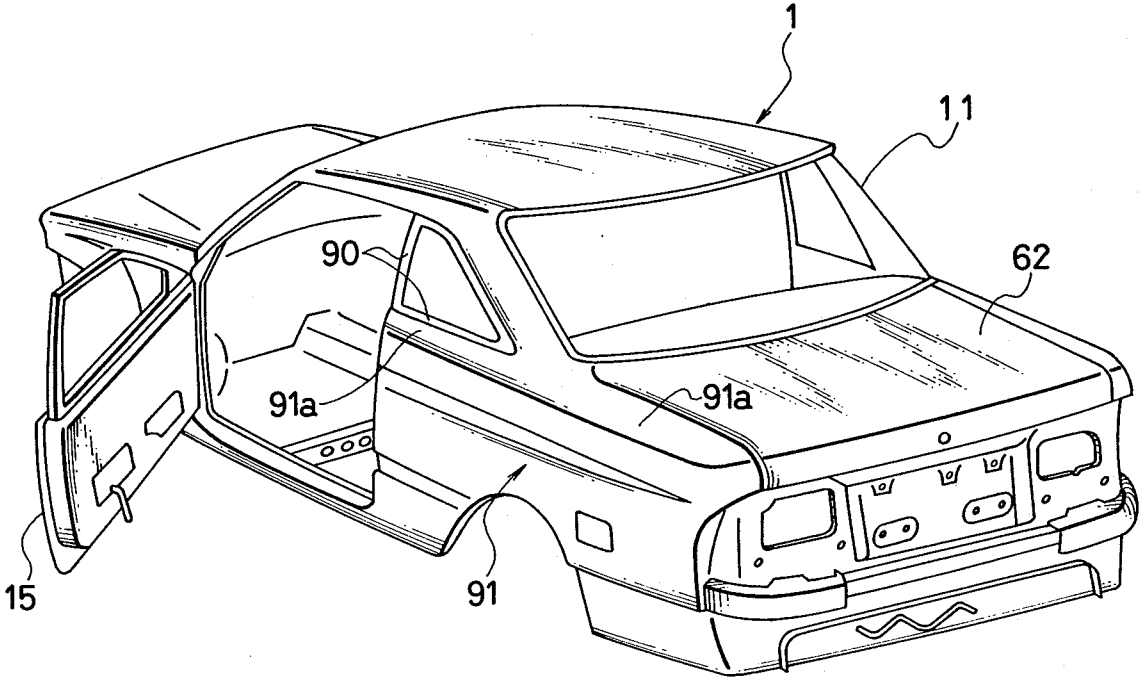
FIG. 12 is a schematic drawing showing a perspective view of a vehicle body of coupe type with two doors to be coated in the embodiment shown in FIG. 5.

Further, FIG. 12 shows a coupe type vehicle body 1 with two doors. Since such a vehicle body 1 has no rear doors and the second and sixth coating robots 82 and 86 cannot coat the inside of the cabin 11, the second and sixth coatinng robots 82 and 86 are respectively allotted right and left outer peripheries of a rear quarter glass 90 and upper portions 91*a* of a rear fender 91.

According to the above described embodiment, although a total of four coating robots are provided for each of the first and second coating stations, since the respective coating robots provided for each of the first and second coating stations 3 and 4 are allotted portions which are not adjacent to each other nor facing each other, it is possible to prevent adjacent coating robots from interfering with each other and increase the coating area allotted to each of the coating robots thereby reducing the coating time and, therefore, the vehicle bodies can be effectively coated with a smaller number of the coating stations.

As described above, in accordance with the present invention, it is possible to reduce the time for coating vehicle bodies with a smaller number of coating stations and to efficiently coat vehicle bodies without interference between coating robots.

The present invention has thus been shown and described with the reference to specific embodiments. However, it should be noted that the present invention is in no way limited to the details of the described arrangements but changes and modifications may be made without departing from the scope of the appended claims.

We claim:

1. An automatic spray coating apparatus for vehicle bodies comprising first and second coating stations, each of said coating stations have two floor-mounted coating robots for coating their own allotted portions of the inside of cabin of the vehicle body, said two coating robots at each of the first and second coating stations being arranged on opposite sides with respect to the vehicle bodies to be conveyed and offset from each other in the direction of conveyance of vehicle bodies to be coated and being disposed for coating respective allotted portions of the vehicle bodies which are neither adjacent to nor facing each other, and at least one hanging coating robot for coating the insides of an engine compartment and a trunk, said hanging coating robot being movable in the vertical direction over a conveyor line for the vehicle bodies.

2. An automatic spray coating apparatus for vehicle bodies in accordance with claim 1 in which said hanging coating robot is constituted to be able to coat either the engine compartment or the trunk when the vehicle body is standing still at the first coating station and to coat the other when the vehicle body is standing still at the second coating station.

3. An automatic spray coating apparatus for vehicle bodies being conveyed intermittently comprising first and second coating stations, said first coating station being provided with first, second and third coating robots in order with respect to a direction of conveyance of the vehicle bodies, said second coating station being provided with fourth, fifth and sixth coating robots in order with respect to said direction of conveyance, and a seventh coating robot provided between the first and second coating stations, said first coating robot being disposed for coating an allotted area of a rear end part on one side of a vehicle body, said sixth coating robot being disposed for coating an allotted area of a front end part on the same side of the vehicle body coated by said first coating robot, said seventh coating robot being disposed for coating an allotted area of the front end part on the other side of the vehicle body at the first coating station and another allotted area of the rear end part on the other side of the vehicle body at the second coating station, said second and fifth coating robots being disposed for coating respective allotted areas of a middle part on the same side of the vehicle body as coated by said seventh coating robot, said third and fourth coating robots being disposed for coating respective allotted areas of a middle part on the opposite side of the vehicle body to that coated by said seventh coating robot, said allotted areas, for the second, third, fourth and fifth coating robots being neither adjacent to nor facing each other.

4. An automatic spray coating apparatus for vehicle bodies in accordance with claim 3 in which said seventh coating robot is installed on guide means movable between the first and second coating stations.

* * * * *